US005495321A

United States Patent [19]

Sunaga et al.

[11] Patent Number: 5,495,321

[45] Date of Patent: Feb. 27, 1996

[54] DEVELOPING APPARATUS HAVING A TONER REGULATING MEMBER WITH AN EXTENDED LIFETIME

[75] Inventors: Takayuki Sunaga; Akihiko Kato; Takashi Sakamoto; Hideaki Miyata, all of Ebina, Japan

[73] Assignee: Fuji Xerox Co., Ltd., Tokyo, Japan

[21] Appl. No.: 321,326

[22] Filed: Oct. 11, 1994

[30] Foreign Application Priority Data

Jan. 7, 1994 [JP] Japan ..... 6-000448

[51] Int. Cl.[6] ..... G03G 15/06

[52] U.S. Cl. ..... 355/245; 355/253

[58] Field of Search ..... 355/245, 246, 355/253

[56] References Cited

U.S. PATENT DOCUMENTS

| | | | |
|---|---|---|---|
| 4,566,402 | 1/1986 | Shimazaki | 118/653 |
| 4,624,545 | 11/1986 | Yasuda et al. | 355/253 |
| 5,215,845 | 6/1993 | Yusa et al. | 355/251 |

FOREIGN PATENT DOCUMENTS 5-289484 11/1993 Japan .

*Primary Examiner*—Nestor R. Ramirez
*Attorney, Agent, or Firm*—Oliff & Berridge

[57] ABSTRACT

A developing apparatus using monocomponent developer comprising: monocomponent magnetic toner; a developer carrying body for carrying and transporting the monocomponent magnetic toner; a magnetic field generation unit fixed inside the developer carrying body; a developer supply unit for supplying the developer carrying body with the monocomponent magnetic toner; and a developer trimming member furnished to the developer supply unit for pressed contact with the circumference of the developer carrying body. The developer trimming member is made of a spring material and tipped with a sliding part which contacts the circumference of the developer carrying body slidingly and which is made of a rubber material. In this setup, the following condition is met:

$$aP>bP$$

where, P stands for the initial point of contact of the sliding part with the developer carrying body, a for the upstream end position of the sliding part in the direction of sliding, b for the downstream end position of the sliding part in the direction of sliding, aP for the length of the line segment connecting the position a with the point P, and bP for the length of the line segment connecting the position b with the point P.

14 Claims, 6 Drawing Sheets

DEVELOPING APPARATUS HAVING A TONER REGULATING MEMBER WITH AN EXTENDED LIFETIME

BACKGROUND OF THE INVENTION

1. Field of the Invention

The present invention relates to a developing apparatus using monocomponent magnetic developer for developing electrostatic latent images.

2. Description of the Related Art

There exist developing apparatuses using monocomponent developer, each comprising an electrostatic latent image carrying body with a developer carrying body positioned opposite thereto. In operation, the developer carrying body is covered with a thin layer of the developer so that the developer is transferred from the developer carrying body to the electrostatic latent image carrying body for visual image development. The developing process takes place in what is known as the developing region of the apparatus where the two bodies are positioned opposite to each other.

In this type of developing apparatus, the developer stocked within a developer housing is first applied onto the surface (i.e., sleeve) of the developer carrying body. As the sleeve rotates in the direction of its circumference, the developer is transported over the entire sleeve surface. The developer carrying body is exposed where the developer housing is opened toward the electrostatic latent image carrying body. It is in that position of exposure that the developer carrying body is furnished opposite and close to the electrostatic latent image carrying body.

A developer trimming member is provided to form a thin layer of developer over the developer carrying body. This member is made illustratively of a stainless steel spring material (e.g., SUS 304 CSP ¾H) tipped with a silicone rubber part. Also furnished are side sealing members that prevent developer leakage from portions other than the image region in the axial direction of the developer carrying body as well as from the gap between the developer carrying body and the developer housing.

The arrangements above constitute the basic specifications according to which a large number of developing apparatuses have been developed and commercially employed in printers and copiers of low process speeds.

Today, developing apparatuses are required to provide ever higher process speeds (20 CPM or more in A4 size), longer life (the same as that of the connected image forming apparatus), and higher reliability (elimination of secondary trouble in image quality caused by disturbed toner supply or transport). Of these requirements, that of the prolonged life has been met by recently introduced developing apparatuses using monocomponent developer in a specific manner. That is, these apparatuses are capable of eliminating the need for the periodical change of developer (carrier), the need having long being associated with developing apparatuses using two-component developer.

There were many cases in which the above-mentioned requirements were not meet by hard copy developing apparatus because of their irregularities. More specifically, the difficulty was attributed to three major factors: (1) a failed side sealing member (resulting in toner leaks), (2) the developer trimming member deformed (by interference with the developer carrying body, temperature change, entry of impurities, etc.), and (3) a worn-out silicone rubber part at the tip of the developer trimming member.

The factor (1) above (side sealing member failure) has been resolved by improvements disclosed in U.S. patent application Ser. No. 08/048,231 filed by the same applicant having filed this invention. Specifically, two improvements are involved: (A) the side sealing members are kept either in non-contact relation to the developer trimming member or are brought into contact with it under a force level such as not to deform it; and (B) the developer trimming member is held in contact with the developer carrying body at the three o'clock position of the latter (perpendicular to the sleeve surface) to optimize the trimming pole position, coupled with partitions for removing deposits of excess toner.

The factor (2) above (deformed developer trimming member) has been resolved by another improvement proposed by the applied patent cited, Specifically, the improvement involves having the developer trimming member bonded to a developer housing fastening plate made of the same material, i.e., the SUS 304 CPS ¾H spring material furnished with a silicone rubber part.

However, the factor (3) above (worn-out silicone rubber part) has yet to be resolved by any of the improvements proposed by the applied patent above. In may cases of printers and copiers of the past with relatively short service lives (equivalent to 100,000 copies or less), the life of the developer trimming member used to be the same as, or shorter than, that of the connected image forming apparatus. Where necessary, the failed developer trimming member or the entire developing apparatus was replaced to deal with the problem of silicone rubber wear.

With the above factors (1) and (2) resolved and with the developing apparatuses improved correspondingly in performance, higher process speeds (20 CPM or more in A4 size) are being required of and implemented by these apparatuses. Whereas the improvements of the applied patent cited above have been implemented and the high process speed requirement is being met, there still remains the problem of the costly service addressing the trimming member replacement.

SUMMARY OF THE INVENTION

It is therefore an object of the present invention to provide a developing apparatus using monocomponent developer and offering a service life at least equivalent to that of the image forming apparatus connected.

In carrying out the invention and according to one aspect thereof, there is provided a developing apparatus using monocomponent developer comprising: monocomponent magnetic toner; a developer carrying body for carrying and transporting the monocomponent magnetic toner; magnetic field generation means fixed inside the developer carrying body; developer supply means for supplying the developer carrying body with the monocomponent magnetic toner; and a developer trimming member furnished to the developer supply means for pressed contact with the circumference of the developer carrying body, the developer trimming member being made of a spring material and tipped with a sliding part which contacts the circumference of the developer carrying body slidingly and which is made of a rubber material; wherein the following condition is met:

$$aP>bP$$

where, P stands for the initial point of contact of the sliding part with the developer carrying body, a for the upstream end position of the sliding part in the direction of sliding, b for the downstream end position of the sliding part in the direction of sliding, aP for the length of the line segment connecting the position a with the point P, and bP for the length of the line segment connecting the position b with the point P.

In a preferred structure according to the invention, the following conditions are met:

$$w \geqq lot,\ r > w$$

where, w stands for the width of the sliding part in the direction of sliding, t for the thickness of the sliding part, and r for the radius of the developer carrying body.

In another preferred structure according to the invention, the sliding part is pressed into contact with the surface of the developer carrying body in a substantially perpendicular manner.

In the developing apparatus of the above constitution, the sliding part of the developer trimming member is given a longer life against the frictional wear on the upstream portion of the part in the sliding direction. This in turn prolongs the life of the whole sliding part against frictional wear, with the result that the developing apparatus using monocomponent toner has a service life as long as that of the image forming apparatus connected.

These and other objects, features and advantages of the invention will become more apparent upon a reading of the following description and appended drawings.

DESCRIPTION OF THE PREFERRED EMBODIMENTS

Figure 1:
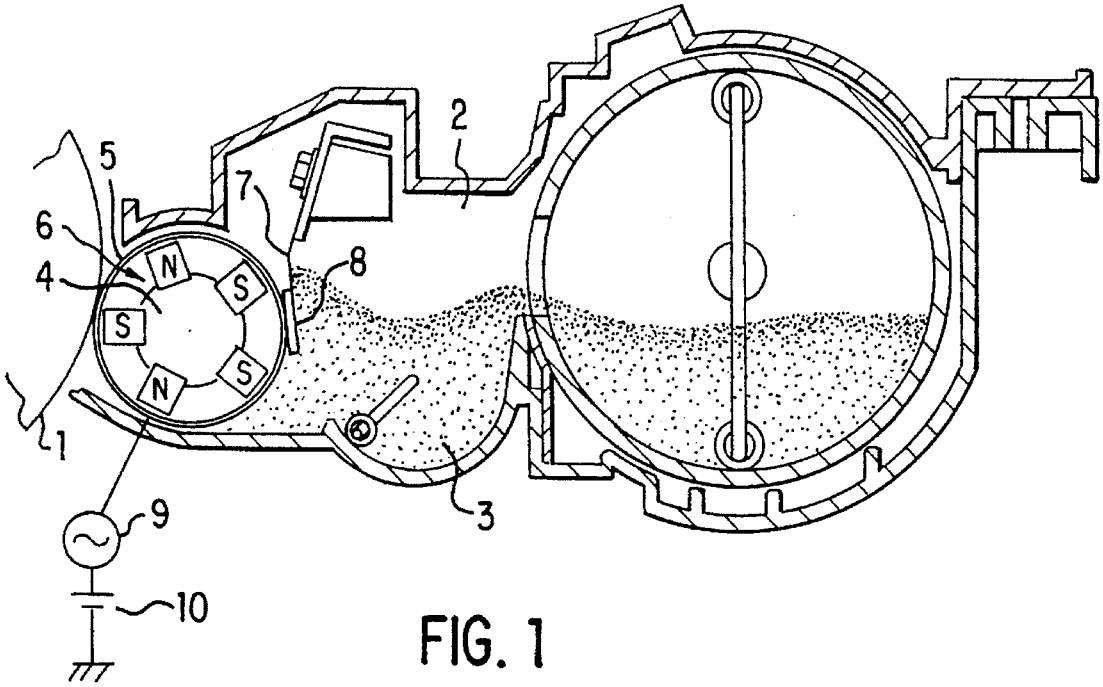
FIG. 1 is a cross-sectional view of a developing apparatus using monocomponent developer embodying the invention.

Preferred embodiments of the invention will now be described with reference to the accompanying drawings. FIG. 1 is a cross-sectional view of a developing apparatus using monocomponent developer embodying the invention. In FIG. 1, reference numeral 1 represents a photoconductive drum (i.e., electrostatic latent image carrying body). Charging means, not shown, charges the entire surface of the photoconductive drum 1 before the latter is exposed. At this point, the surface potential is illustratively minus 700 volts and the background potential is illustratively minus 150 volts. Reference numeral 2 is a hopper that accommodates monocomponent magnetic toner 3 (or simply called the toner). The toner 3 contains 48 wt % of magnetic powder. A magnet roll 4 has N- and S-poles arranged alternately in the circumferential direction. The magnet roll 4 is attached fixedly to a frame, not shown. Reference numeral 5 denotes a phenolic resin cylinder called a sleeve with a wall thickness of 1.5 mm and having a resistivity value of $4.2\times10^6$ Ω·cm. The sleeve 5 is a semiconductive sleeve polished in the axial direction so as to have an average surface roughness (Rz) of 8.5 μm or more measured at 10 points under JIS (Japanese Industrial Standards) provisions. The sleeve 5 surrounds the magnet roll 4 and is supported in a pivotably rotatable manner. The magnet roll 4 and the sleeve 5 constitute a developer carrying body 6. Reference numeral 7 represents a developer trimming member made of nonmagnetic stainless steel (SUS 304 CSP ¾H) and having a thickness of 0.1 mm. The developer trimming member 7 is tipped in vulcanized fashion with a sliding part 8 which has a hardness of 50° and is made of a silicone rubber piece 1 mm thick. The sliding part 8 is brought into contact with the sleeve 5 at the three-o'clock position of the latter (perpendicular to the sleeve surface) under the force of 90 g/cm.

The surface roughness of the sleeve 5 should preferably be raised by 50 to 70% over conventional sleeves. In specific terms, the 10-point average roughness (Rz) should range from 6 to 11 μm and should be set optimally to 8.5 μm±1.0 μm. The contact pressure of the sliding part 7 (i.e., linear pressure in this case) should preferably be made lower than that for conventional sliding parts. Specifically, the pressure should range from 70 to 110 g/cm and optimally from 80 to 100 g/cm.

In experiments, the embodiment of the abovedescribed constitution was set up within a copier so that the gap between the sleeve 5 of the developer carrying body 6 and the photosensitive drum 1 was 250 μm or less. In this setup, an AC power source 9 and a DC power source 10 supplied the sleeve 5 with a DC biased AC voltage having a frequency of 2.4 kHz, a peak-to-peak voltage of 2000 V and a DC component of minus 250 V.

Figure 4:
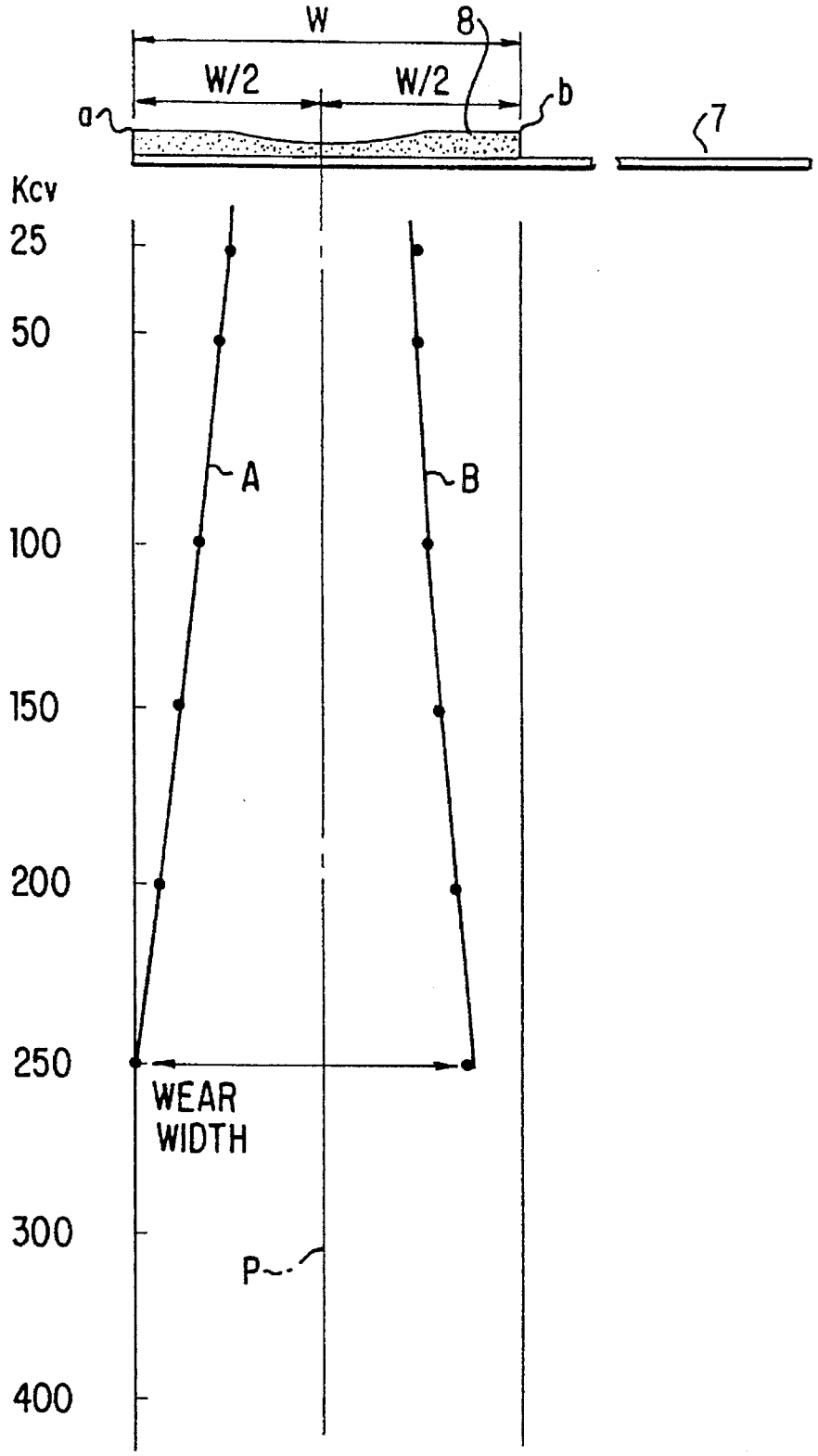
FIG. 4 PRIOR ART
FIG. 4 is a diagram illustrating the life of a conventional sliding part.

Copies were produced continuously in the above setup and checked for image quality periodically. In keeping with the continuous copy production, the sliding part 8 (of silicone rubber) was observed for wear over its contact surface. The observation led to several new findings. FIG. 4 is a diagram showing how the amount of copy operation Kcv of a typical conventional developing apparatus using monocomponent developer is related to the silicone rubber wear of the sliding part 8 contacting the sleeve surface.

Figure 2:
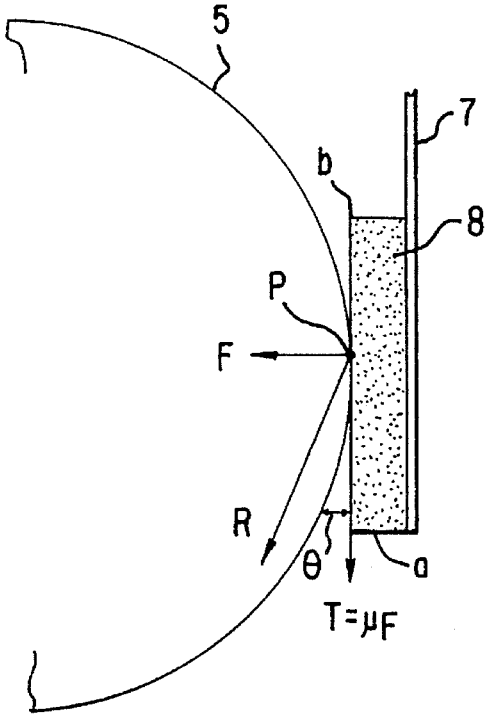
FIG. 2 is a schematic view enlarging the sliding part of the developer trimming member of the invention.

Below is a description of what is known as a blade linear pressure of the sliding part 8. Referring to FIG. 2, the blade linear pressure is represented by a resultant force R produced by a pressing force F from the deflecting developer trimming member 7 and by a frictional force T from the rotating sleeve 5. Here, the two kinds of force are in the relation $$T=\mu F$$

where, μ represents a frictional coefficient that varies with the surface roughness of the sleeve 5 and with the presence or absence of toner. The blade linear pressure R is measured and established through primary regression to the static torque of the sleeve 5 and to the initial target (i.e., the case where the point of contact has minimum wear).

In the setup of FIG. 2, the contact point P is determined by strict mathematical expressions (defining the amount of deflection, free length, part mounting position, etc.) and by the static torque of the developer carrying body 6, as illustrated. Conventionally, the contact point P at the initial stage of sliding has been set in the middle of the rubber width w of the sliding part 8 (i.e., w/2). This is because the middle of the sliding part width is considered to be the center point that allows equally for wear on the upstream and the downstream side as the amount of wear increases over continuous operation Kcv.

The inventors of this invention examined closely how the silicone rubber of the conventional sliding part 8 wore over time. It was found that in all experiments involving the developing apparatus at the end of its life equivalent to a copy count of 250 Kcv, the wear of the sliding part 8 reached the upstream end position a; the wear did not reach the downstream end position b.

The reason for the difference in wear between the upstream and the downstream side on the sliding part 8 is explained below with reference to FIGS. 2 and 3. There exists a considerable difference in terms of the existing amount of toner 3 between the upstream end position a and the downstream end position b on the sliding part 8. Specifically, the toner 3 is always present in the vicinity of the upstream end position a. As the sleeve 5 rotates, the toner 3 is fed into a wedge angle θ between the sleeve surface and the sliding part 8. At the contact point P, a thin layer of toner 3 is formed under the blade linear pressure R so that a certain amount of toner 3 is charged sufficiently to effect image development. There is a limit to the amount of toner 3 that may pass the contact point P in the unit time; the rest of the toner 3 flows downward by its own weight along the upstream end position a. In this setup, the upstream end position a is subject to pressure from the toner 3.

Toward the downstream end position b, the toner 3 that was allowed to pass the contact point P is attached to the surface of the sleeve 5 by two kinds of force: Coulomb force caused by frictional electrification, and magnetic force from the magnets inside the sleeve 5. Once past the contact point P, the toner 3 has no relevance to the downstream end position b; the downstream end position b is not subject to any pressure from the toner 3.

Figure 3:
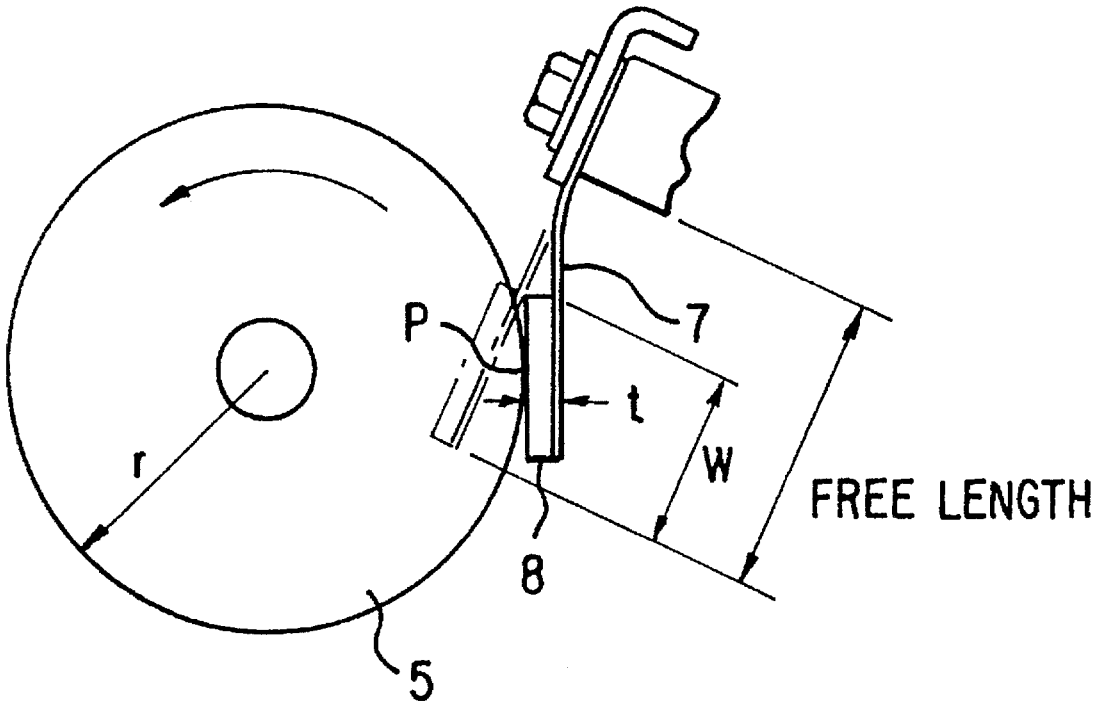
FIG. 3 is a view depicting the relationship between the sliding part and its free length of the developer trimming member.

As shown in FIG. 3, the width, W, of the sliding part 8 is characterized with respect to a free length of the trimming member 7 when in a relaxed state.

The above-mentioned conditions result in the particular state of wear indicated in FIG. 4 in connection with the conventional developing apparatus. As shown, the width of wear reached the upstream end position a at the copy count of 250 Kcv.

The embodiment of the invention comprises the following measures to provide a longer life (a life as long as that of the image forming apparatus connected). As one such measure, the progress of wear width is delayed by lowering the initial blade linear pressure. Implementing this measure makes gentler what may be called a wear curve A (FIG. 4) of the wear width eventually reaching the upstream end position a. The wear curve B is that of the wear width toward the downstream end position b.

The initial blade linear pressure could be reduced by lowering the pressing force F. However, an attempt to lower the pressing force F would also reduce the frictional force T, which would aversely affect the frictional electrification given to the toner 3. To maintain the frictional force T requires raising the frictional coefficient μ, a component of the resultant force R (blade linear pressure). This requirement was met in tests by raising the surface roughness of the sleeve 5 by 50 to 70% over conventional sleeves (Rz= 8.5 μm or more).

Figure 5:
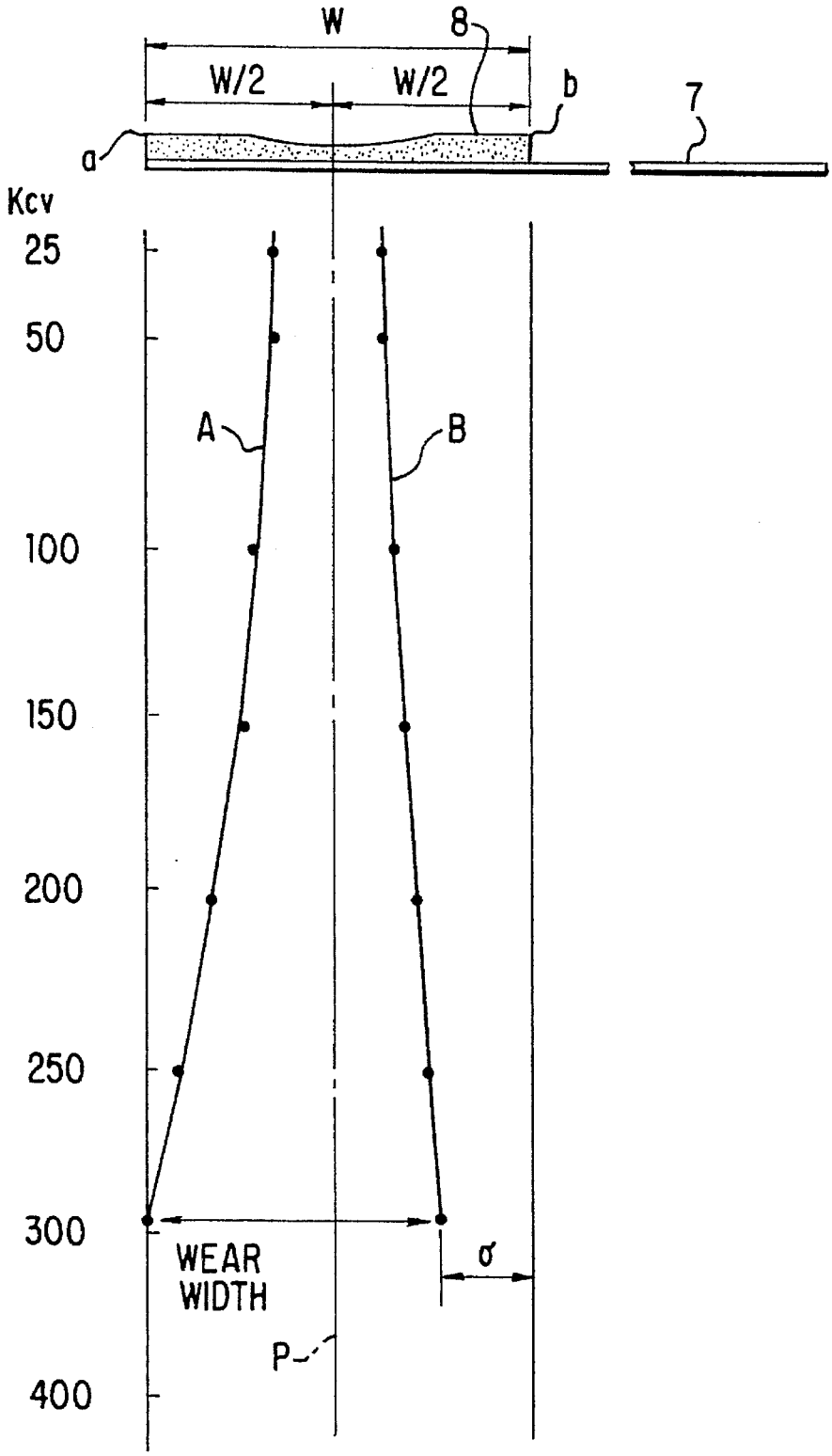
FIG. 5 PRIOR ART
FIG. 5 is a diagram depicting the life of another conventional sliding part.

FIG. 5 plots the results of the tests conducted on the conventional developing apparatus under the above conditions. The tests proved the extension of the service life from 250 to 300 Kcv, as illustrated. However, there still remained an unworn portion δ (FIG. 5) toward the downstream end position b at the end of the life. Taking this phenomenon as a hint to prompt further improvement, the inventors came up with another measure for service life extension.

Figure 6:
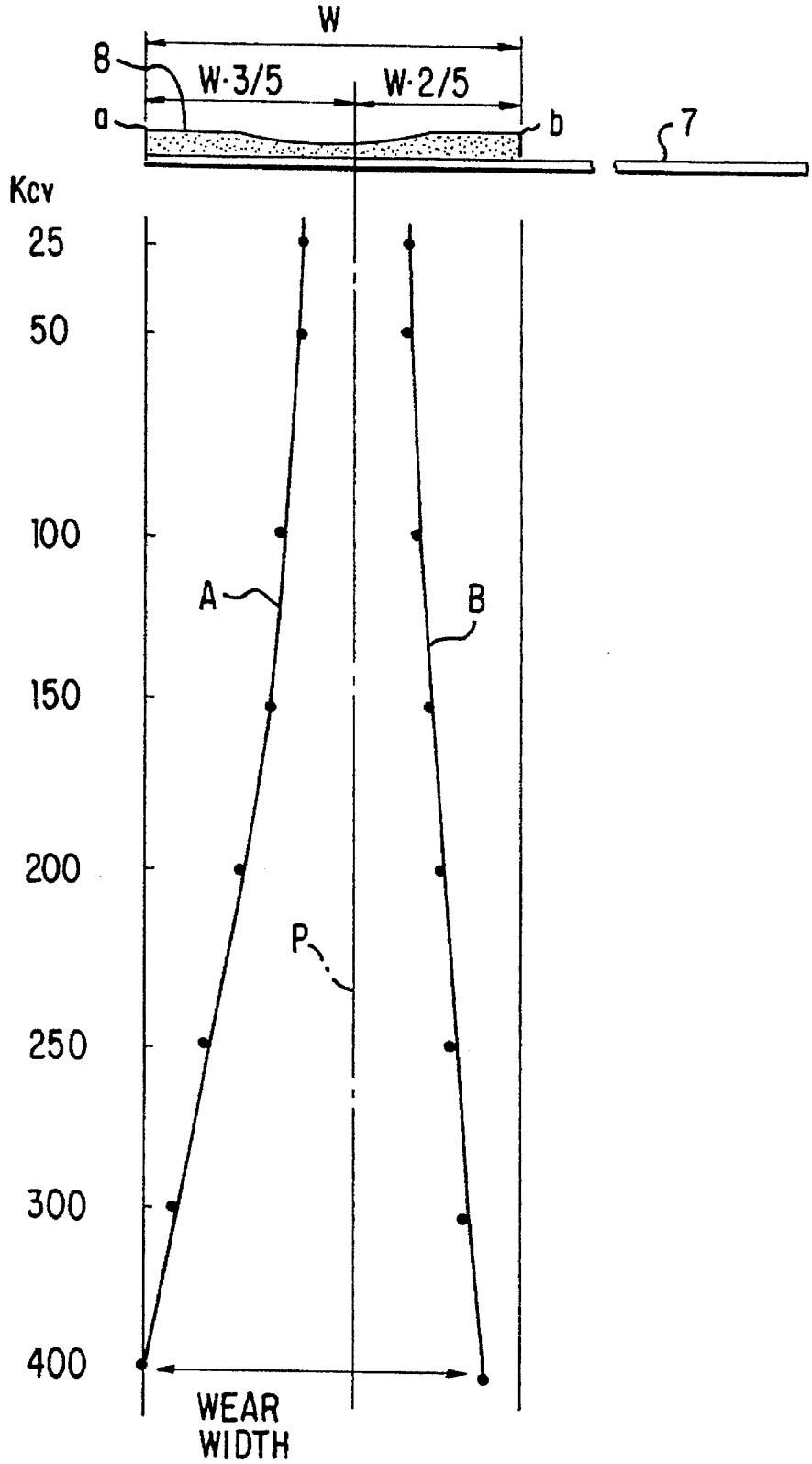
FIG. 6 is a diagram showing the life of the sliding part used by the embodiment.

As shown in FIG. 6, where there was provided the same width as that of the conventional sliding part, the contact point P was shifted from the customary w/2 position toward the downstream end position b and up to the point dividing the width into 3w/5 and 2w/5, as illustrated. The shifting of the contact point P prolonged the life to 400 Kcv. In this case, however, it should be noted that the shortened free length between the fastening point of the developer trimming member 7 and the contact point P reduces the deflection of the member 7, thereby changing the pressing force F.

As a further measure for service life extension, the following conditions were stipulated and met:

$$w \geqq 10t,\ r > w$$

where, w stands for the Width of the sliding part 8 in the direction of sliding, t for the thickness of the sliding part 8, and r for the radius of the developer carrying body 6 (sleeve 5) as shown in FIG. 3.

Figure 7:
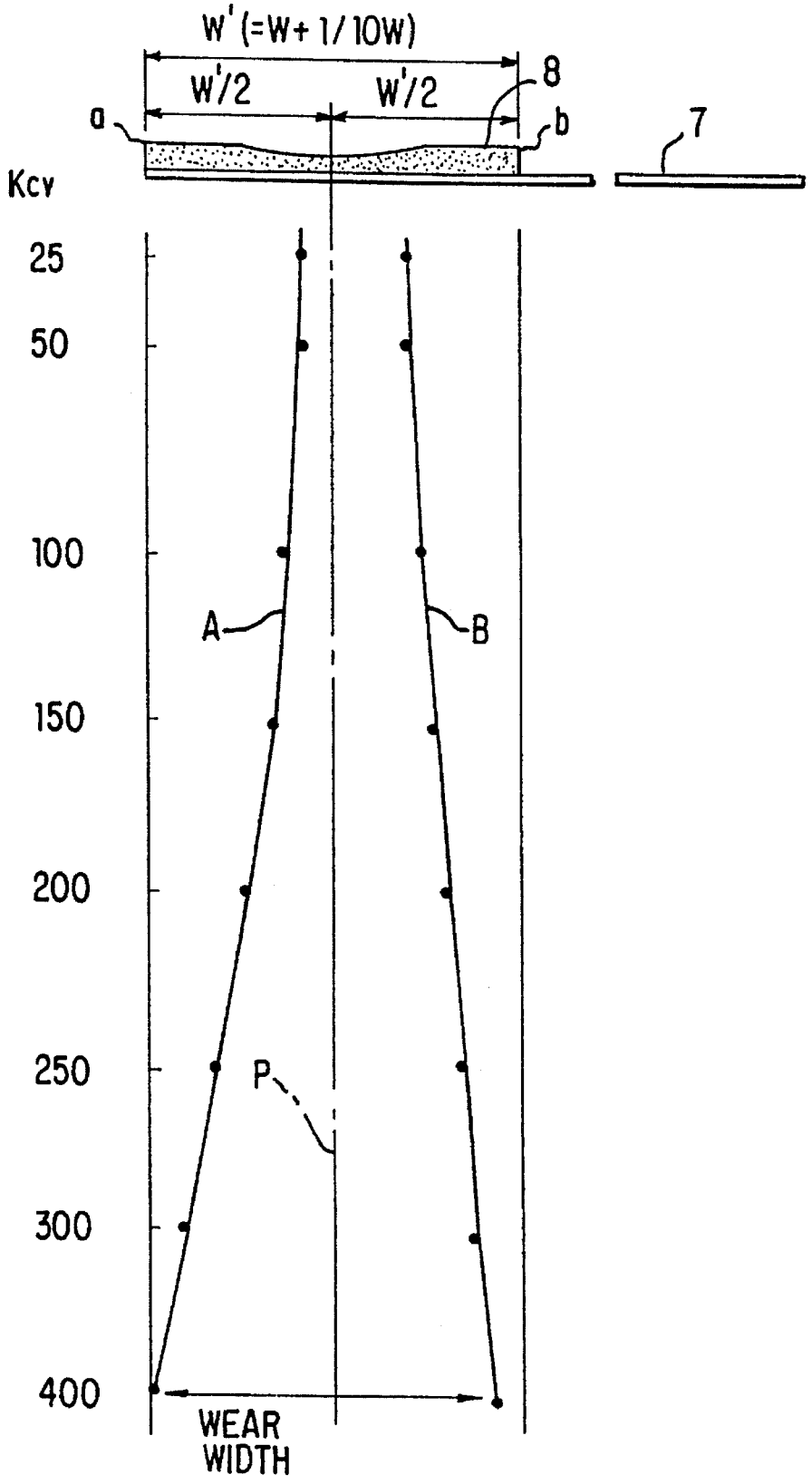
FIG. 7 is a diagram illustrating the life of the sliding part used by another embodiment of the invention.

In the above embodiment, the contact point P was shifted toward the downstream end position b. Alternatively, the width w of the sliding part 8 in the sliding direction may be widened by about 10%. The advantage of this alternative is that the sliding part 8 and sleeve 5 may be kept in the same positional relation to the contact point 5; the formation of a thin layer of toner 3 and the electrification thereof remain unaffected. The increase of the wear region toward the upstream end position a prolongs the wear curve A reaching that position a. As a result, the life of the sliding part 8 is found to extend from the initial 250 Kcv to 400 Kcv as shown in FIG. 7, which is a 60% increase in service life.

As described, the invention extends significantly the life of the sliding part 8 on the developer trimming member 7. This in turn allows the developing apparatus using monocomponent developer to have a service life as long as that of the image forming apparatus connected therewith.

As many apparently different embodiments of this invention may be made without departing from the spirit and scope thereof, it is to be understood that the invention is not limited to the specific embodiments thereof except as defined in the appended claims.

What is claimed is:

1. A developing apparatus using monocomponent developer, comprising:

monocomponent magnetic toner;

a developer carrying body for carrying and transporting said monocomponent magnetic toner;

magnetic field generation means located inside said developer carrying body;

developer supply means for supplying said developer carrying body with said monocomponent magnetic toner; and a flexible metal trimming member mounted inside said developer supply means for pressing a rubber sliding part affixed to one end of said trimming member against an outer surface of said developer carrying body to slidingly engage said developer carrying body;

wherein the following condition is met:

$$aP > bP$$

where, P comprises a contact point of said sliding part with said developer carrying body, a comprises an upstream end position of said sliding part in a direction of rotation of said developer carrying body, b comprises a downstream end position of said sliding part in the direction of rotation of said developer carrying body, aP comprises a distance between the upstream end position a and the contact point P, and bP comprises a distance between the downstream end position b and the contact point P, and wherein the following conditions are met:

$$w \geqq 10t,\ r > w$$

where, w comprises a width of said sliding part in the direction of rotation of said developer carrying body comprises a thickness of said sliding part, and comprises a radius of said developer carrying body.

2. A developing apparatus using monocomponent developer according to claim 1, wherein said sliding part presses against the outer surface of said developer carrying body in a substantially perpendicular direction with respect to the direction of rotation of said developer carrying body.

3. A developing apparatus using monocomponent developer according to claim 1, wherein said developer carrying body includes a sleeve covering the outer surface of said developer carrying body.

4. A developing apparatus using monocomponent developer according to claim 3, wherein said sleeve is comprised of phenolic resin material.

5. A developing apparatus using monocomponent developer according to claim 3, wherein said sleeve has a wall thickness of approximately 1.5 mm.

6. A developing apparatus using monocomponent developer according to claim 3, wherein said sleeve has a resistivity of approximately $4.2\times10^6$ Ω·cm.

7. A developing apparatus using monocomponent developer according to claim 3, wherein said sleeve has a surface roughness of approximately 8.5 μm.

8. A developing apparatus using monocomponent developer according to claim 1, wherein said trimming member is comprised of non-magnetic stainless steel.

9. A developing apparatus using monocomponent developer according to claim 8, wherein said trimming member has a thickness of approximately 0.1 mm.

10. A developing apparatus using monocomponent developer according to claim 1, wherein said sliding part has a hardness of approximately 50°.

11. A developing apparatus using monocomponent developer according to claim 1, wherein said sliding part has a thickness of approximately 1 mm.

12. A developing apparatus using monocomponent developer according to claim 1, wherein said sliding part presses against said developer carrying body with a pressure in the range of approximately 70–110 g/cm.

13. A developing apparatus using monocomponent developer according to claim 1, wherein said sliding part contacts said developer carrying body at a contact point such that the distance between the downstream end position and the contact point is substantially equal to approximately two-fifths of the width of said sliding part in the direction of rotation of said developer carrying body.

14. A developing apparatus using monocomponent developer according to claim 1, wherein said sliding part contacts said developer carrying body at a contact point such that the distance between the upstream end position and the contact point is substantially equal to approximately three-fifths of the width of said sliding part in the direction of rotation of said developer carrying body.

* * * * *